US011602234B1

(12) United States Patent
Fort

(10) Patent No.: US 11,602,234 B1
(45) Date of Patent: Mar. 14, 2023

(54) DISPLAY VASE AND URN

(71) Applicant: Marc A Fort, Slippery Rock, PA (US)

(72) Inventor: Marc A Fort, Slippery Rock, PA (US)

( * ) Notice: Subject to any disclaimer, the term of this patent is extended or adjusted under 35 U.S.C. 154(b) by 192 days.

(21) Appl. No.: 16/921,917

(22) Filed: Jul. 6, 2020

Related U.S. Application Data

(63) Continuation-in-part of application No. 15/810,323, filed on Nov. 13, 2017, now abandoned.

(51) Int. Cl.
*A47G 7/06* (2006.01)
*A61G 17/08* (2006.01)

(52) U.S. Cl.
CPC ..... *A47G 7/06* (2013.01); *A61G 17/08* (2013.01)

(58) Field of Classification Search
CPC ... A01G 5/00; A47G 7/02; A47G 7/06; A61G 17/08
See application file for complete search history.

(56) References Cited

U.S. PATENT DOCUMENTS 2,997,199 A * 8/1961 Reachi ..... A47G 7/06 220/630
6,526,636 B2 * 3/2003 Bernhardt ..... E04H 13/008 40/725
9,358,171 B1 * 6/2016 Crawford ..... A61G 17/004

FOREIGN PATENT DOCUMENTS

KR 200470339 Y1 * 12/2013 ..... A01G 9/02
KR 20140062302 A * 5/2014 ..... A47G 1/065
WO WO-03053197 A1 * 7/2003 ..... A47G 7/025

* cited by examiner

*Primary Examiner* — David J Parsley
*Assistant Examiner* — Danielle A Clerkley
(74) *Attorney, Agent, or Firm* — Richard K Thomson

(57) ABSTRACT

A vase and vase urn are each equipped with a plurality of windows for mounting photos, lyrics and the like, for adorning tables at weddings, funerals and other ceremonies of note. Retention rings can be of a snap-fit design or press fit to retain the memorabilia in the windows.

13 Claims, 7 Drawing Sheets

DISPLAY VASE AND URN

BACKGROUND AND SUMMARY OF THE INVENTION

The present invention is directed to the field of household decor. More particularly, the present invention is directed to a decorative vase and urn which has multiple display locations around it perimeter for mounting pictures, song lyrics, Bible verses etc.

Vases and urns have been around for millennia. Chances are Eve used a vase to display a bouquet on Adam's table shortly after they were booted from the garden of Eden. The point is vases have been around forever and very little in the way of innovation has transpired in this arena.

A first embodiment of the present invention comprises a vase with a plurality of display windows (between 3 and 6, most preferably 4) distributed about the periphery of the vase. Each window includes a frame element and a retention ring to secure a photo, lyrical sheet, or the like, in the frame element. These vases can be adorned with photos of the happy couple and/or song lyrics for a wedding or anniversary celebration; photos of a deceased loved one at a funeral dinner or wake; and could, of course, be adapted for everyday household use where photos could be changed to reflect the changing seasons, holidays, birthdays, etc.

A second similar embodiment incorporates the frame and retention ring in a vase/urn in which an upper portion is the flower-receiving vase and the lower portion is a separate ash-receiving compartment into which the ashes of a loved one (person or pet) may be secured. A bottom is cemented, soldered, or welded securely onto the body of the urn and a plug threaded therein to seal the ashes in the urn.

A rotational or non-rotational base can optionally be provided for either the vase or the vase/urn, the rotational base allowing the vase to be rotated for ease of viewing the pictures displayed in the various windows by persons seated in various positions around a table, for example.

The vase is preferably manufactured from a rigid plastic material using 3D printing techniques, while the urn/vase is made of metal. Most preferably the urn will be formed of a first metallic material and then plated with a more expensive (precious) metal such as gold, platinum, silver, brass, or the like, given its need for long term durability and displayability.

Various other features, advantages, and characteristics of the present invention will become apparent after a reading of the following detailed description.

BRIEF DESCRIPTION OF THE DRAWINGS

The preferred embodiment(s) of the vase/urn of the present invention are described in conjunction with the associated drawings in which like features are indicated with like reference numerals and in which.

DETAILED DESCRIPTION OF THE PREFERRED EMBODIMENT(S)

Figure 1:
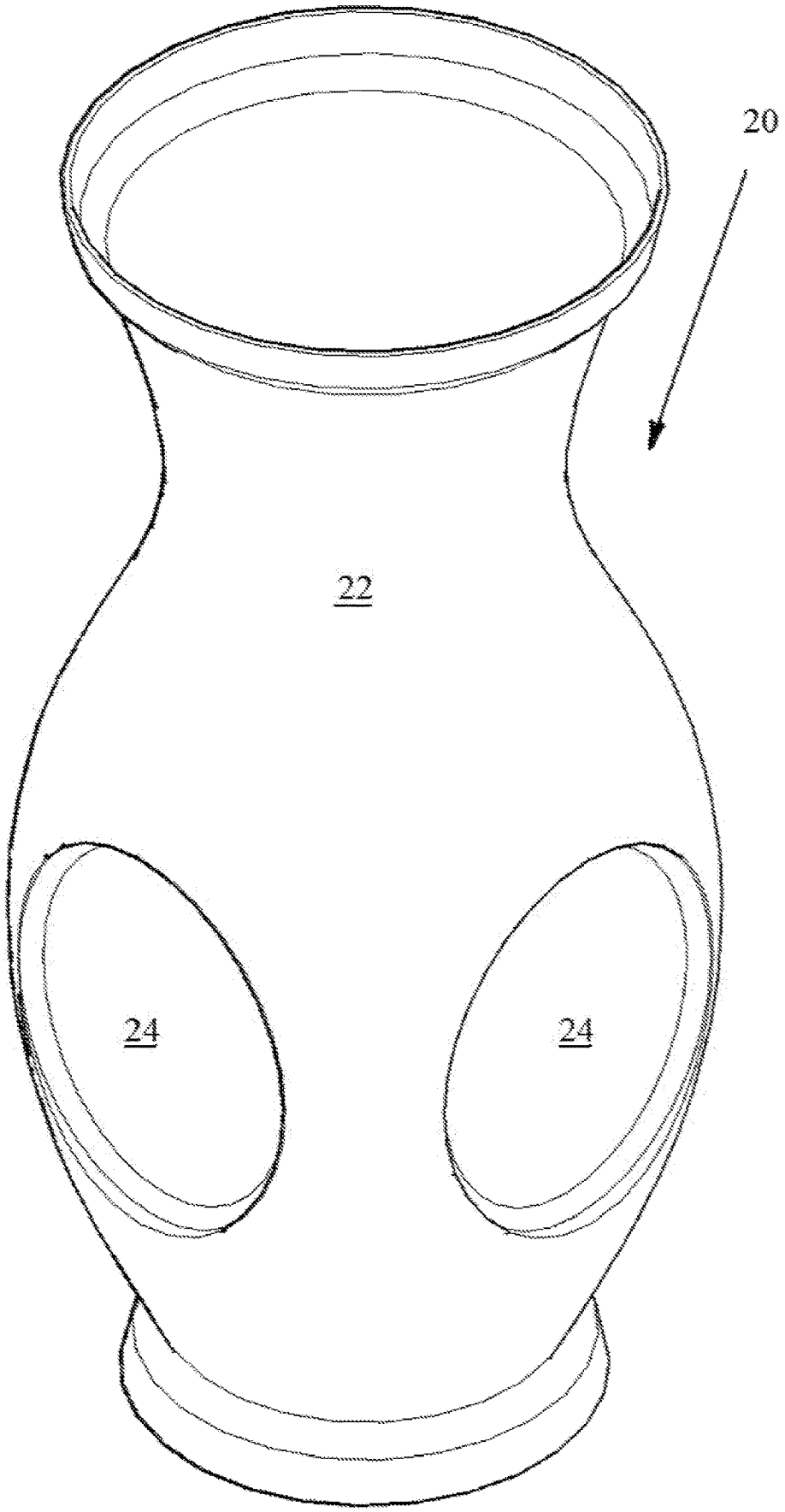
FIG. 1 is front perspective view of a first embodiment of the vase of the present invention.
Figure 2:
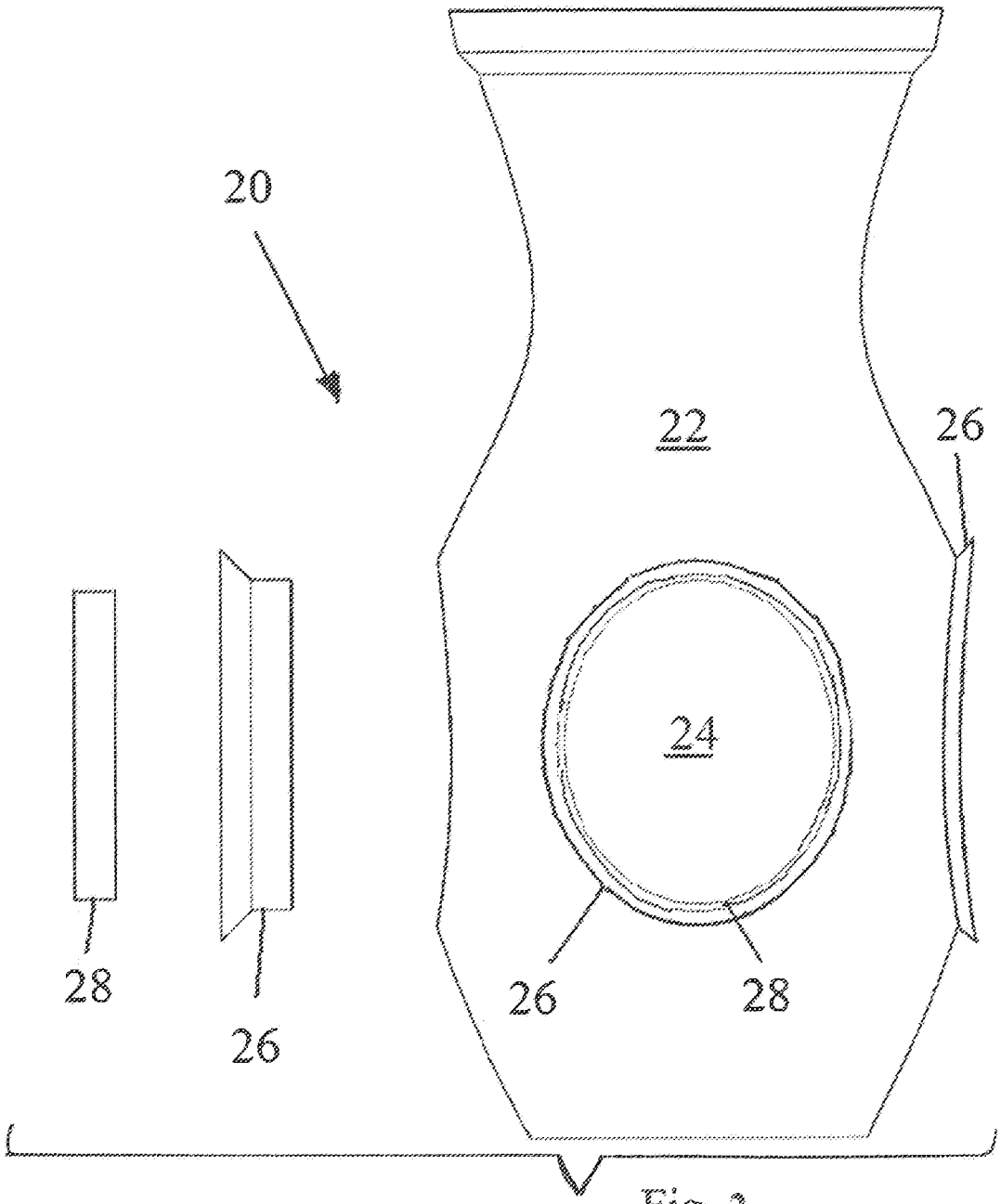
FIG. 2 is a front exploded perspective view of the first embodiment.

A first embodiment of the display vase of the present invention is shown in FIGS. 1-2 generally at 20. Display vase 20 has a body 22 with a neck, round bottom, a region extending upwardly from the neck and flaring outwardly to the mouth at the top. A central region is formed with a plurality of display regions or windows 24, 24*a*, 24*b* which are recessed, having a flat back wall. While the number of windows may be varied from 3 to 6, most preferably there will be four windows 24 equally spaced about the central region. Each of the windows is equipped with a similarly shaped framing element 26 and a retention ring 28. Framing element 26 can be retained via a friction fit or may be cemented in place using a suitable glue. Although it is preferred that retention ring 28 be left for insertion and removal to facilitate changing the contents of the display window 24, it too may be cemented in place if desired. However, more preferably, the photo is trimmed to be slightly oversized for the opening, and the retention ring 28 is inserted atop the photo or lyric sheet sandwiching the peripheral edge of the element retaining it for display in window 24. As mentioned, the use of 3D printers enables the ready manufacture of the components of vase 20 of a durable plastic material with the features enumerated herein. Alternatively, the vase 20 may be made of ceramic or glass.

Figure 3:
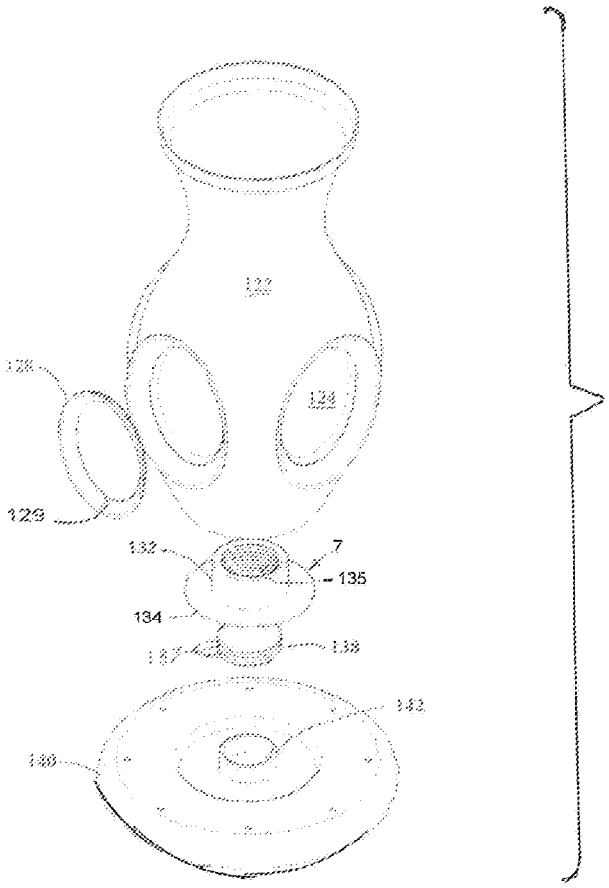
FIG. 3 is a front exploded view of the second embodiment.
Figure 3A:
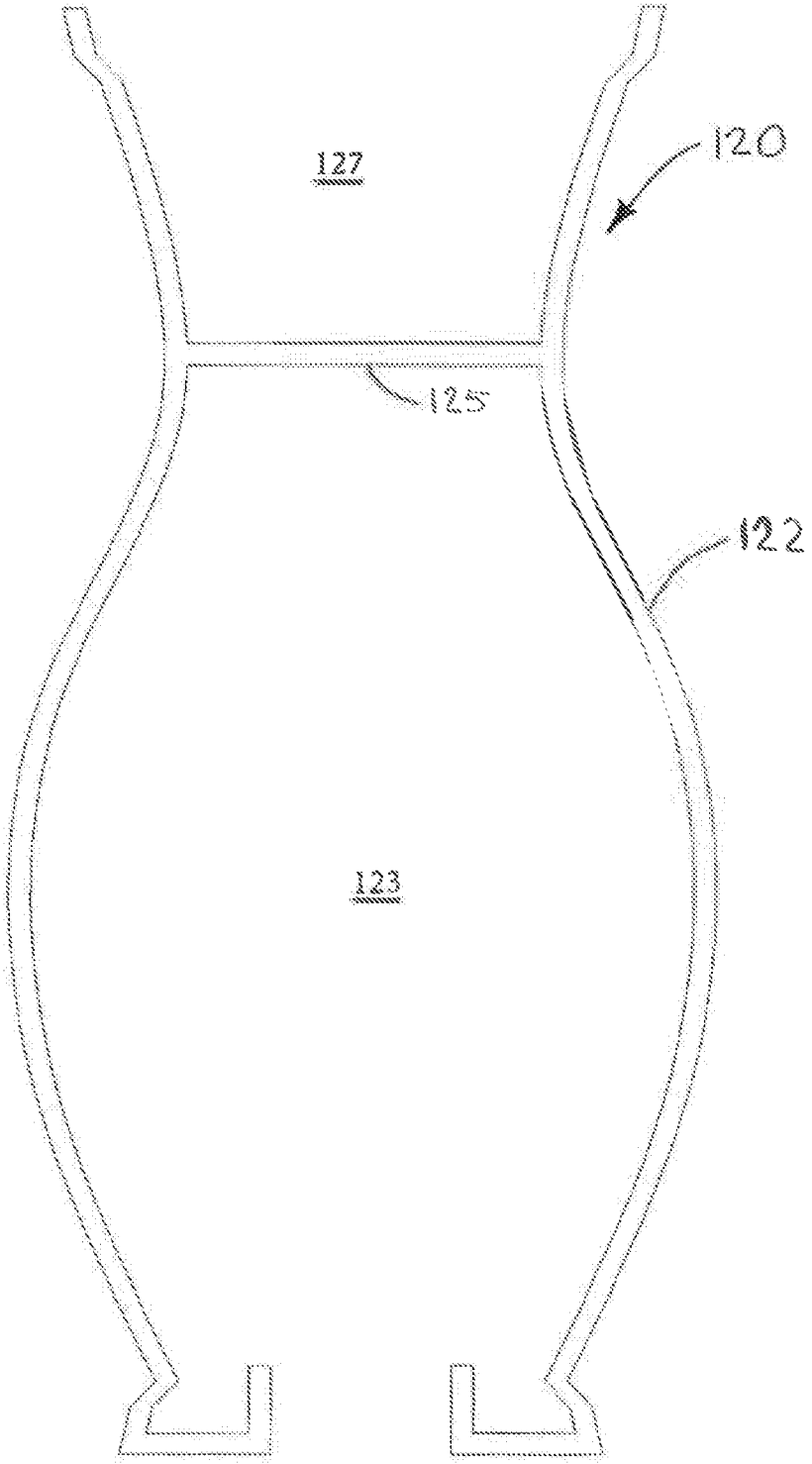
FIG. 3A is a cross-sectional view of the second embodiment.
Figure 3B:
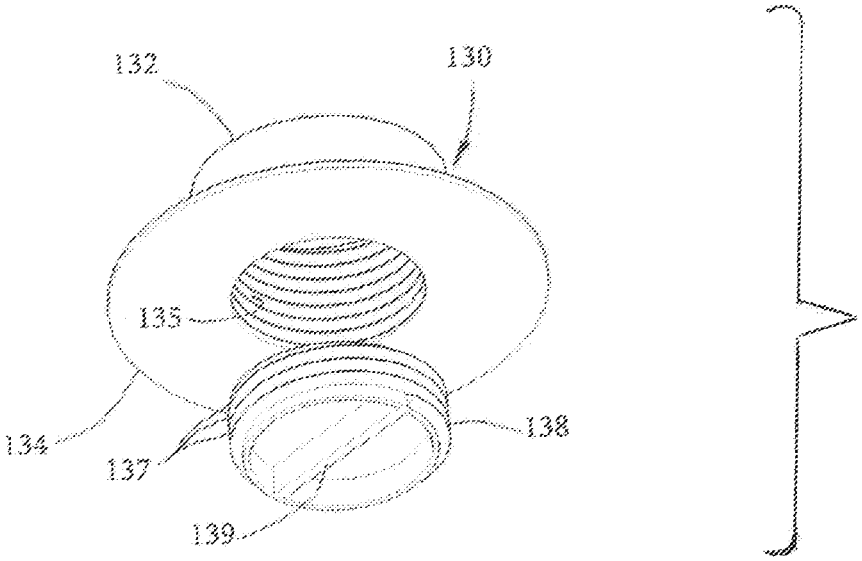
FIG. 3B is a partial bottom perspective view of the second embodiment.

A second embodiment featuring an urn/vase 120 is depicted generally in FIGS. 3-3B. The body 122 of vase 120 is subdivided into bottom urn section 123 and upper vase section 127 by an interior wall 125 (see FIG. 3A). The wall 125 may be cemented, welded or soldered in place to secure it to the interior of vase 120. However securement is effected, it must provide a leak-proof compartment for the bottom urn section 123. It will be appreciated that this wall may subdivide compartment of vase body 122 above the windows 124, below the windows 124 or anywhere along the vertical extent of windows 124. Preferably, retention ring 128 has a slit 129 that effectively creates a cylindrical spring providing spring tension in the opening. Since the urn/vase 120 of this embodiment is made of a metallic material, the wall 125 and the contents of the bottom urn 123 will not be visible from outside the vase 120.

Figure 4:
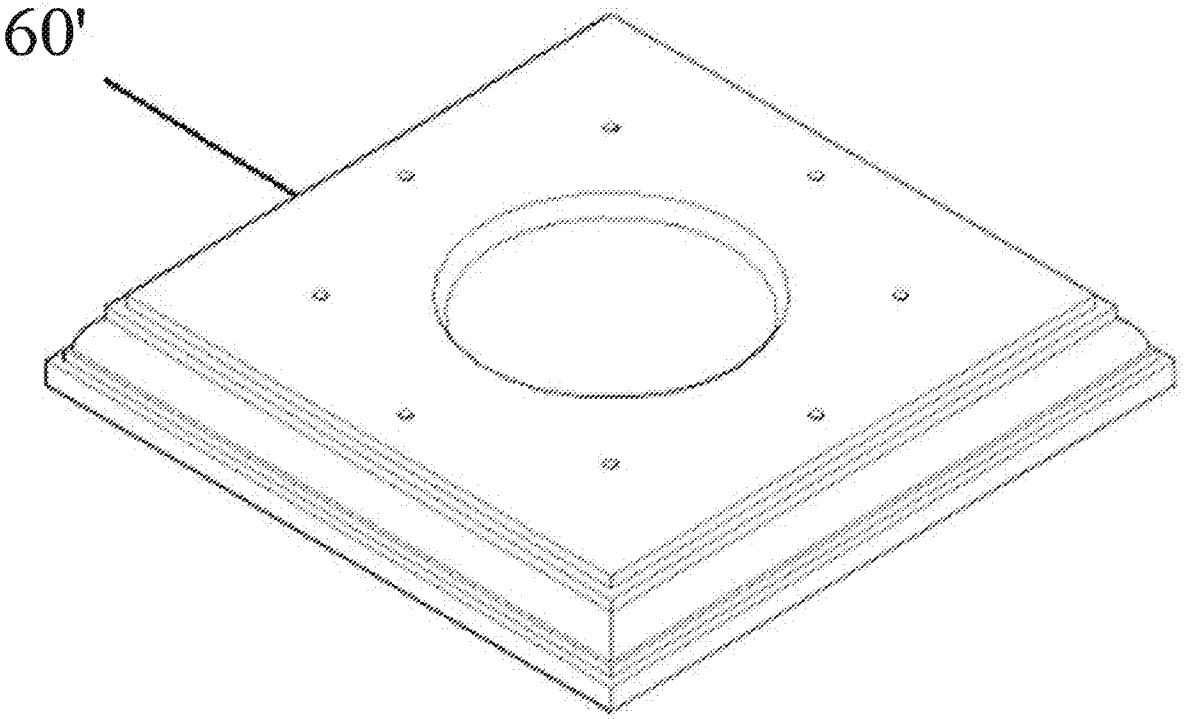
FIG. 4 is a top perspective view of a second base usable with either the first, second or third embodiments.
Figure 4A:
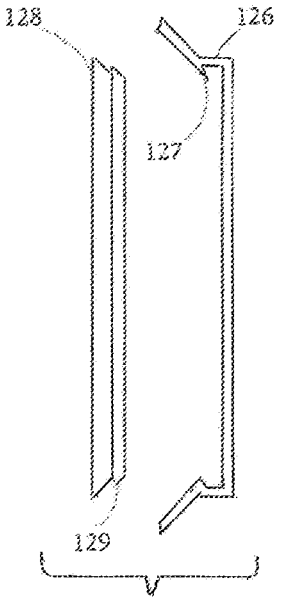
FIG. 4A is a partial exploded side view of a third embodiment.

A variation in the third embodiment depicted in FIG. 4A relates to the retention ring 128. Framing element 126 has an inwardly protruding tang 127 that engages a cylindrical protruding flange 129 on retention ring 128. Ring 128 snaps into framing element 126 and can be removed by applying force to the outer portion of the framing element 126.

Bearing ring 40 and support base 60 can be used with the vase 20 of the first embodiment Typically, however, these features are optional with vase 20 and will only be used to dress up the vase for a formal occasion, such as a wedding or funeral. These items are available, however, for use at the purchaser's discretion. Bearing ring 40 is seated in the central opening 62 of base 60 and facilitates rotation of vase 20 or urn/vase 120 to permit persons seated around a table, for example, to view the photos and lyrics displayed in windows 24, 124. While the exception for the vase 20, these items will more commonly be used with the urn/vase 120 although, here again, the purchaser can choose not to use them with the urn/vase, as well. Base 60 shown in FIG. 3 is cylindrical. However, a variety of additional shapes and configurations are possible including the square base 60' shown in FIG. 4.

Bottom portion 130 (FIG. 3) is made separately from vase 120 for ease of manufacture. Bottom portion 130 may be affixed to the bottom of vase 120 by cementing, welding, or soldering, depending on the specific material used and the application for which the vase 120 is intended. Bottom portion 130 has a central hub 132 and a laterally extending flange 134. Central hub 132 has an internal thread 135 to receive plug 138 which has external threads 137 which are of like pitch and thread design so as to be readily received in internal thread 135. Rib 139 allows plug 138 to be inserted once the ashes have been poured into bottom urn portion 130. This will most preferably be performed by personnel at the mortuary/crematorium and the plug may be cemented in place to avoid spillage. Base 140 has a cylindrical post 142 received in central hub 132 to stabilize the vase/urn 120 against lateral tipping.

The display vase 20 and the urn/vase 120 of the present invention afford a unique opportunity to honor newly weds and recently deceased loved ones by displaying photos, favorite song lyrics, Bible verses, and the like, in the windows 24, 124 adorning the periphery of vase 20 and urn/vase 120.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A display vase usable as a table decoration for holding flowers, said vase comprising a) a generally cylindrical central region having a plurality of elongated display regions recessed into said generally cylindrical central region for mounting pictures or song lyrics, each of said plurality of display regions employing a removable retention ring secured in said display region to retain the pictures or song lyrics and having a flat back wall defining an inner limit of said recessed display regions;

b) a narrowing neck region above said generally cylindrical central region;

c) said removable retention ring being configured in a shape essentially identical to said elongated display regions and is insertable therein, each said removable retention ring having a slit such that said removable retention ring forms a cylindrical spring biased outwardly into said display region;

d) an upper mouth flaring outwardly from said narrowing neck region and having an open top;

e) a cylindrical bottom positioned beneath and unified with said generally cylindrical central region.

2. The display vase of claim 1 said plurality of display regions equaling four positioned equally around a periphery of said generally cylindrical central region.

3. The display vase of claim 1 wherein each said display region includes a frame element extending angularly outwardly defining a recess, said removable retention ring including a protruding flange which is complementarily shaped to engage in said angularly outwardly defined recess.

4. The display vase of claim 1 further comprising a geometrically shaped base having a central opening for receiving said cylindrical bottom of said vase.

5. The display vase of claim 4 wherein said geometrically shaped base is cylindrical.

6. The display vase of claim 4 wherein said geometrically shaped base is square.

7. An urn/vase hybrid for use as a decorative vessel, said urn/vase hybrid comprising:

a) a generally cylindrical central region having a plurality of elongated display regions recessed into said generally cylindrical central region for mounting pictures or song lyrics, each of said plurality of display regions having i) a flat back wall defining an inner limit of said recessed display region, and, ii) a removable retention ring secured in said display regions to retain the pictures, or song lyrics;

b) said removable retention ring being configured in a shape essentially identical to said elongated display regions and is insertable therein, each said removable retention ring having a slit such that said removable ring forms a cylindrical spring biased outwardly into said display region;

c) a narrowing neck region above said generally cylindrical central region;

d) an upper mouth flaring outwardly from said narrowing neck region and having an open top;

e) a cylindrical bottom positioned beneath and unified with said generally cylindrical central region;

f) a first lower compartment for receiving and retaining ashes of a loved one forming a lower portion of said generally cylindrical central region;

g) an opening in a bottom portion of said lower compartment for receiving the ashes;

h) sealing means for retaining said ashes in said lower compartment;

i) a second compartment above and divided from said first lower compartment by a dividing wall, said second compartment for receiving flowers and decorations.

8. The urn/vase hybrid of claim 7 said plurality of display regions equaling four positioned equally around a periphery of said generally cylindrical central region.

9. The urn/vase hybrid of claim 7 wherein each display region includes a frame element extending angularly outward defining a recess, said removable retention ring including a protruding flange which is complementarily shaped to engage in said angularly outwardly defined recesss.

10. The urn/vase hybrid of claim 7 further comprising a geometrically shaped base having a central opening for receiving said cylindrical bottom of said vase.

11. The urn/vase hybrid of claim 10 wherein said geometrically shaped base is cylindrical.

12. The urn/vase hybrid of claim 10 wherein said geometrically shaped base is square.

13. The urn/vase hybrid of claim 10 further comprising securing means engagable with said bottom portion of said lower compartment, said securing means being received in said geometrically shaped base.

* * * * *